US012071264B2

(12) United States Patent
Lopes et al.

(10) Patent No.: US 12,071,264 B2
(45) Date of Patent: Aug. 27, 2024

(54) APPARATUS FOR WRAPPING A LOAD AND ASSOCIATED METHODS

(71) Applicant: WULFTEC INTERNATIONAL INC., Ayer's Cliff (CA)

(72) Inventors: Guy Lopes, Sherbrooke (CA); Priscille Tremblay, Coaticook (CA)

(73) Assignee: WULFTEC INTERNATIONAL INC., Québec (CA)

( * ) Notice: Subject to any disclaimer, the term of this patent is extended or adjusted under 35 U.S.C. 154(b) by 0 days.

(21) Appl. No.: 18/221,466

(22) Filed: Jul. 13, 2023

(65) Prior Publication Data

US 2023/0356866 A1 Nov. 9, 2023

Related U.S. Application Data

(62) Division of application No. 17/067,050, filed on Oct. 9, 2020, now Pat. No. 11,738,895.

(60) Provisional application No. 62/914,101, filed on Oct. 11, 2019.

(30) Foreign Application Priority Data

Oct. 11, 2019 (CA) ..... CA 3058590

(51) Int. Cl.
*B65B 11/58* (2006.01)
*B65B 11/04* (2006.01)

(52) U.S. Cl.
CPC ..... *B65B 11/585* (2013.01); *B65B 11/045* (2013.01)

(58) Field of Classification Search
CPC ..... B65B 11/00; B65B 11/58; B65B 11/585; B65B 11/045
USPC ..... 53/399, 445, 449, 156, 176, 587, 588, 53/441
See application file for complete search history.

(56) References Cited

U.S. PATENT DOCUMENTS 4,712,354 A * 12/1987 Lancaster ..... B65B 11/58 53/399
6,065,269 A 5/2000 Malnati
6,688,076 B1 * 2/2004 Rivera, Jr. ..... B65B 25/24 53/204

(Continued)

OTHER PUBLICATIONS

Canadian Patent Application Serial No. 3,058,590, Examination Report, Mar. 14, 2024, 5 pages.

*Primary Examiner* — Jacob A Smith
(74) *Attorney, Agent, or Firm* — Ryan, Mason & Lewis LLP

(57) ABSTRACT

There is provided a method for wrapping a load comprising an upper portion defining an upper peripheral surface and a lower portion defining a lower peripheral surface. The method includes configuring a first material dispenser including a first material web in a first starting position and a second material dispenser including a second material web in a second starting position. The method includes and providing a rotation between the load and the material dispensers, such that, upon the rotation, the first material dispenser wraps the upper peripheral surface of the load with the first material web and the second material dispenser wraps the lower peripheral surface of the load with the second material web. The first material dispenser wraps the upper peripheral surface of the load simultaneously while the second material dispenser wraps the lower peripheral surface of the load during at least a portion of a wrapping cycle.

17 Claims, 8 Drawing Sheets

(56) References Cited

U.S. PATENT DOCUMENTS

| | | | | |
|---|---|---|---|---|
| 6,775,956 | B1 * | 8/2004 | Lacey | B65B 11/585 53/399 |
| 9,944,417 | B2 | 4/2018 | Lemieux et al. | |
| 2004/0168949 | A1 * | 9/2004 | Ours | B65B 11/045 206/527 |
| 2008/0184676 | A1 * | 8/2008 | Downhill | B65B 11/008 53/465 |
| 2011/0030317 | A1 * | 2/2011 | Murarotto | B65B 57/10 53/399 |
| 2014/0331609 | A1 * | 11/2014 | Bison | B65B 11/585 53/219 |
| 2015/0251786 | A1 * | 9/2015 | Downhill | B65B 41/16 53/399 |

* cited by examiner

APPARATUS FOR WRAPPING A LOAD AND ASSOCIATED METHODS

PRIORITY

The present application is a divisional application of U.S. Ser. No. 17/067,050, filed Oct. 9, 2020, which claims priority to U.S. Provisional Patent Application Ser. No. 62/914,101, filed Oct. 11, 2019, and entitled "Apparatus for Wrapping a Load and Associated Methods," the contents of each of which are incorporated by reference herein in their entirety.

FIELD

The technical field relates to an apparatus and associated methods for wrapping a load.

BACKGROUND

Wrapping apparatuses and associated methods can be used to wrap a load with a material web. Existing wrapping apparatuses typically include one wrapping material dispenser for dispensing the material web to the load. Upon a relative rotation between the wrapping material dispenser and the load, the material web is applied to the load.

The speed at which a load can be wrapped depends on several factors, such as, for example, the dimensions and shape of the load, as well as the relative rotation speed between the wrapping material dispenser and the load.

In the instances wherein the load has relatively large dimension, e.g., stacked pallets, or wherein the wrapping speed is a critical factor, e.g., when a substantially large number of loads needs to be wrapped in a substantially small amount of time, it could be useful to increase the speed at which the load can be wrapped.

There is thus a need in the industry for an improved apparatus and associated method for wrapping a load that alleviate at least in part the deficiencies of existing apparatuses and method and seeks to solve problems and drawbacks of the prior art.

SUMMARY

In accordance with one aspect, there is provided a method for wrapping a load comprising an upper portion defining an upper peripheral surface and a lower portion defining a lower peripheral surface, the method comprising: configuring a first material dispenser including a first material web in a first starting position and a second material dispenser including a second material web in a second starting position; and providing a relative rotation between the load, the first material dispenser and the second material dispenser during a wrapping cycle, such that, upon the relative rotation, the first material dispenser at least partially wraps the upper peripheral surface of the load with the first material web and the second material dispenser at least partially wraps the lower peripheral surface of the load with the second material web, wherein the first material dispenser wraps the upper peripheral surface of the load simultaneously while the second material dispenser wraps the lower peripheral surface of the load during at least a portion of the wrapping cycle.

In some embodiments, the method further includes holding a tail of the first material web with a first web-retaining assembly and a tail of the second material web with a second web-retaining assembly before beginning the wrapping cycle and at a beginning of the wrapping cycle.

In some embodiments, the first starting position is spaced apart from the second starting position.

In some embodiments, the method further includes ending the wrapping cycle when the first material dispenser and the second material dispenser respectively reach a first end position and a second end position, and wherein the first starting position is an uppermost position and the first end position is a lowermost position.

In some embodiments, the second starting position is the lowermost position and the second end position is the uppermost position.

In some embodiments, the method further includes ending the wrapping cycle when the first material dispenser and the second material dispenser respectively reach a first end position and a second end position, and wherein the first starting position is an uppermost position and the second starting position is a lowermost position.

In some embodiments, the first end position and the second end position is a junction of the upper portion and the lower portion.

In accordance with another aspect, there is provided a method for wrapping a load comprising an upper portion defining an upper peripheral surface and a lower portion defining a lower peripheral surface, the method comprising positioning a first material dispenser including a first material web at a first starting position and a second material dispenser including a second material web at a second starting position; providing a relative rotation between the load, the first material dispenser and the second material dispenser during a wrapping cycle; and translating, during the wrapping cycle, the first material dispenser from the first starting position towards a first end position and the second material dispenser from the second starting position towards a second end position, such that, upon the relative rotation, the first material web at least partially overlaps with the second material web during at least a portion of the wrapping cycle.

In some embodiments, the method further includes holding a tail of the first material web with a first web-retaining assembly and a tail of the second material web with a second web-retaining assembly before providing the relative rotation and at a beginning of the wrapping cycle.

In some embodiments, the first starting position is spaced apart from the second starting position.

In some embodiments, the first starting position is an uppermost position and the first end position is a lowermost position and the second starting position is a second lowermost position and the second end position is a second uppermost position.

In accordance with another aspect, there is provided an apparatus for wrapping a load with a first web material and a second web material, the load comprising an upper portion having an upper surface and defining an upper peripheral surface and a lower portion having a lower surface and defining a lower peripheral surface, the apparatus comprising a dispenser frame having a first starting position, a first end position, a second starting position, and a second end position; a first wrapping material dispenser mounted to the dispenser frame and being vertically translatable therealong and along a first wrapping path extending between the first starting position and the first end position, the first wrapping material dispenser being configured to at least partially wrap the upper peripheral surface of the load with the first web material upon a relative rotation between the load and the first wrapping material dispenser during a wrapping cycle; a second wrapping material dispenser mounted to the dispenser frame and being vertically translatable therealong and along a second wrapping path extending between the second starting position and the second end position, the second wrapping material dispenser being configured to at least partially wrap the lower peripheral surface of the load with the second web material upon a relative rotation between the load and the second wrapping material dispenser during the wrapping cycle; a first web retaining assembly adjacent to the first starting position to hold a tail of the first web material; and a second web retaining assembly adjacent to the second starting position to hold a tail of the second web material.

In some embodiments, the first starting position is spaced-apart from the first end position and the second starting position is spaced apart from the second end position.

In some embodiments, the first wrapping path extends in the upper portion of the load and the second wrapping path extends in the lower portion of the load.

In some embodiments, the first wrapping path and the second wrapping path at least partially overlap.

In some embodiments, the first starting position and the first end position are vertically aligned with the upper portion of the load and the second starting position and the second end position are vertically aligned with the lower portion of the load.

In some embodiments, the first starting position is vertically aligned with one of the upper portion and the lower portion of the load and the first end position is vertically aligned with the other one of the upper portion and the lower portion of the load and the second starting position is vertically aligned with one of the upper portion and the lower portion of the load and the second end position is vertically aligned with the other one of the upper portion and the lower portion of the load.

In some embodiments, the dispenser frame comprises a first stationary dispenser support supporting the first wrapping material dispenser and a second stationary dispenser support, spaced-apart from the first dispenser support, and supporting the second wrapping material dispenser.

In some embodiments, the dispenser frame comprises a first rotating arm supporting the first wrapping material dispenser and a second rotating arm supporting the second wrapping material dispenser, the first and the second rotating arms being engageable in rotation about the load during the wrapping cycle.

In accordance with another aspect, there is provided an apparatus for wrapping a load, the load having an upper portion defining a top part and an upper periphery and a lower portion defining a bottom part and a lower periphery, the load extending along a main longitudinal axis from the bottom part to the top part, the apparatus comprising:

(a) a top member for contacting the top part of the load;

(b) a bottom member for receiving the bottom part of the load;

(c) a first material dispenser comprising a first material supply for supplying a first material web, the first material dispenser being translatable along a first longitudinal axis between a first position adjacent to the top member and a second position spaced apart from the first position;

(d) a second material dispenser comprising a second material supply for supplying a second material web, the second material dispenser being translatable along a second longitudinal axis between a first position adjacent to the bottom member and a second position spaced apart the first position;

(e) a first retaining member for gripping a tail of the first material web, the first retaining member being mounted to the top member such that, in use, the first retaining member is adjacent to the top part of the load; and (f) a second retaining member for gripping a tail of the second material web, the second retaining member being mounted to the bottom member such that, in use, the second retaining member is adjacent to the bottom part of the load;

wherein, in use, the first retaining member grips the tail of the first material web when the first material web starts wrapping the load along the upper periphery of the load and the first material web then continues wrapping the load such that the first material web at least partially covers the upper portion of the load and the second retaining member grips the tail of the second material web when the second material web starts wrapping the load along the lower periphery of the load and the second material web then continues wrapping the load such that the second material web at least partially covers the lower portion of the load.

In some embodiments, in use, the first retaining member no longer grips the tail of the first material web when the load is sufficiently wrapped by the first material web and the second retaining member no longer grips the tail of the second material web when the load is sufficiently wrapped by the second material web.

In some embodiments, the first material dispenser comprises a first longitudinal guiding member for guiding the first material web and a first longitudinal cutter, the first longitudinal guiding member and the first longitudinal cutter each being movable along a transversal axis from a proximal position to a distal position and wherein the second material dispenser comprises a second longitudinal guiding member for guiding the second material web and a second longitudinal cutter, the second longitudinal guiding member and the second longitudinal cutter each being movable from a proximal position to a distal position.

In some embodiments, in use, the first longitudinal guiding member guides the first material web when the first material web wraps the load and the second longitudinal guiding member guides the second material web when the second material web wraps the load.

In some embodiments, in use, the first material web wraps the load up to a first cutting position wherein the first material web no longer wraps the load and the second material web wraps the load up to a second cutting position wherein the second material web no longer wraps the load.

In some embodiments, in use, in the first cutting position of the first material web, the first longitudinal guiding member moves transversally up its distal position for retaining the first material web against the load and the first longitudinal cutter then moves transversally up to its distal position for contacting and cutting the first material web, and in the second cutting position of the second material web, the second longitudinal guiding member moves transversally up to its distal position for retaining the second material web against the load and the second longitudinal cutter then moves transversally up to its distal position for contacting and cutting the second material web.

In some embodiments, the first longitudinal guiding member comprises first and second longitudinal guiding arms for receiving therebetween the first material web and the second longitudinal guiding member comprises first and second longitudinal guiding arms for receiving therebetween the second material web.

In some embodiments, in use, the first material web wraps the load such that that the first material web at least partially covers the lower portion of the load and the second material web wraps the load such that the second material web at least partially covers the upper portion of the load.

In some embodiments, the first material dispenser is mounted to a first stationary support extending along a first support longitudinal axis and the second material dispenser is mounted to a second stationary support extending along a second support longitudinal axis and wherein the main longitudinal axis and first and second support longitudinal axes are generally parallel and are spaced apart from each other.

In some embodiments, the top member is a plate rotatable about the main axis and wherein the first retaining member is mounted to the plate.

In some embodiments, the bottom member is a turnable that is rotatable about the main axis and wherein the second retaining member is mounted to the turnable.

In some embodiments, in use, the first and second material webs are wrapped around the load when the plate and turntable both rotate in a same direction.

In some embodiments, in use, the plate is adated to apply pressure to the top part of the load.

In some embodiments, the first and second material dispensers are mounted to a ring support, the first and second material dispenser being spaced apart from each other, and wherein the first and second material dispensers are both movable along the ring support such that the first and second material webs are wrapped around the load when the first and second material dispensers both rotate in a same direction.

In accordance with another aspect, there is provided an apparatus for wrapping a load, the load having an upper portion defining a top part and an upper periphery and a lower portion defining a bottom part and a lower periphery, the load extending along a main longitudinal axis from the bottom part to the top part, the apparatus comprising:

(a) a top member for contacting the top part of the load;
(b) a bottom member for receiving the bottom part of the load;
(c) a first material dispenser comprising a first material supply for supplying a first material web;
(d) a second material dispenser comprising a second material supply for supplying a second material web;
(e) a first retaining member for gripping a tail of the first material web, the first retaining member being mounted to the top member such that, in use, the first retaining member is adjacent to the top part of the load; and
(f) a second retaining member for gripping a tail of the second material web, the second retaining member being mounted to the top member such that, in use, the second retaining member is adjacent to the top part of the load; and
(g) a rotatable support being translatable along the main longitudinal axis between a first position adjacent to the top member and a second position spaced apart from the first position, the rotatable support being sized to enclose the load;

wherein the first and second material dispensers are mounted to the rotatable support, the first and second material dispenser being spaced apart from each other; and wherein, in use, the first and second material dispensers wrap the first and second material webs around the load upon rotation and translational movement of the rotatable support with respect to the main longitudinal axis.

In accordance with another aspect, there is provided an apparatus for wrapping a load, the load comprising an upper portion defining an upper periphery and a lower portion defining a lower periphery, the apparatus comprising a load support frame comprising a load-receiving surface for supporting the load thereon a head that is spaced-apart from the load-receiving surface, wherein a central axis extends between the head and the load-receiving surface and wherein the head is being abuttable to the load; a first retaining assembly to grip a first material web, the first retaining assembly being mounted to the head; a first material dispenser, the first material dispenser comprising a first material supply for supplying the first material web, the first material supply being translatable along a first axis between a first up position and a first down position; a second retaining assembly to grip a second material web, the second retaining assembly being mounted to the load support frame; and a second material dispenser extending, the second material dispenser comprising a second material supply for supplying the second material web, the second material supply being translatable along a second axis between a second down position and a second up position;

wherein, in use, the first retaining assembly is configured to grip a first end tail of the first material web and to rotate about the upper periphery of the upper portion and the first supply translates from the first up position towards the first down position, thereby wrapping the upper portion of the load across the upper periphery and the second retaining assembly is configured to grip a second end tail of the second material web and to rotate about the lower periphery of the lower portion and the second supply translates from the second down position towards the second up position, thereby wrapping the lower portion of the load across the lower periphery.

In some embodiments, the apparatus further includes a first cutting element for separating a first dispensed material from the first material web and a second cutting element for separating a second dispensed material from the second material web, wherein, in use, the first cutting element is configured to separate the first dispensed material from the first material web after the wrapping of the upper portion of the load and the second cutting element is configured to separate the second dispensed material from the second material web after the wrapping of the lower portion of the load.

In some embodiments, the central axis, the first axis and the second axis are parallel one with respect to another.

In some embodiments, the load-receiving surface comprises a turntable rotatable about the central axis.

In some embodiments, the head comprises an upper plate, the upper plate being rotatable about the central axis.

In some embodiments, the first retaining assembly comprises a first pair of clamps mounted to the head.

In some embodiments, the first pair of clamps is aligned along a first horizontal axis, the first horizontal axis being substantially perpendicular to the central axis.

In some embodiments, the second retaining assembly comprises a second pair of clamps mounted to the load-receiving surface.

In some embodiments, the second pair of clamps is aligned along a second horizontal axis, the second horizontal axis being substantially perpendicular to the central axis.

In some embodiments, in use, the apparatus performs a wrapping cycle comprising a first translational movement of the first material supply from the first up position to the first down position and a second translational movement of the second material supply from the second down position to the second up position.

In some embodiments, the first translational movement and the second translational movement are simultaneous.

In some embodiments, after the wrapping cycle the first material supply returns to a first initial state and the second material supply returns to second initial state.

In some embodiments, the first initial state is the first up position.

In some embodiments, the second initial state is the second down position.

In accordance with another aspect, there provided an apparatus for wrapping a load, the load comprising an upper portion defining an upper periphery and a lower portion defining a lower periphery, the apparatus comprising a load support frame comprising a load-receiving surface for supporting the load thereon; and a head that is spaced-apart from the load-receiving surface, wherein a central axis extends between the head and the load-receiving surface, the head comprising: a ring assembly sized to enclose the load; and first and second arms slidably engaged with the ring assembly, the first and second arms downwardly extending from the ring assembly along respective first axis and second axis, a first retaining assembly adapted to grip a first material web, the first retaining assembly being mounted to the head; a first material dispenser mounted to the first arm and comprising a first material supply for supplying the first material web; and a second retaining assembly adapted to grip a second material web, the second retaining assembly being mounted to the head; and a second material dispenser mounted to the second arm and comprising a second material supply for supplying the second material web;

wherein, in use, the first and second material dispensers wrap the first and second material webs around the load upon rotational movement of the first and second material arms around the load and translational movement of the first and second material dispensers along the first and second arms.

In some embodiments, the ring assembly is an annular structure.

In some embodiments, the central axis, the first axis and the second axis are parallel and wherein the first and second material dispensers are spaced apart from each other.

In some embodiments, in use, the first retaining assembly rotates about the upper periphery of the upper portion and the second retaining assembly rotates about the lower periphery of the lower portion such that the first and second arms each rotates about the central axis for imparting a rotational movement to the respective first and second material dispensers to wrap the upper and lower peripheries of the load.

In some embodiments, the apparatus further includes a first cutting element and a second cutting element each being configured to separate, after a wrapping of the load, a first dispensed material from the first material web and a second dispensed material from the second material web.

In some embodiments, the first retaining assembly comprises a first pair of clamps mounted to the head.

In some embodiments, the first pair of clamps is aligned along a first horizontal axis, the first horizontal axis being substantially perpendicular to the central axis.

In some embodiments, the second retaining assembly comprises a second pair of clamps mounted to the load-receiving surface.

In some embodiments, the second pair of clamps is aligned along a second horizontal axis, the second horizontal axis being substantially perpendicular to the central axis.

In some embodiments, in use, the apparatus performs a wrapping cycle comprising a first translational movement of the ring assembly from the first position to the second position.

In some embodiments, the wrapping cycle further comprises a second translational movement of the head from the second position to the first position.

These and other aspects of the technology will now become apparent to those of ordinary skill in the art upon review of the following description of embodiments of the technology in conjunction with the accompanying drawings.

BRIEF DESCRIPTION OF THE DRAWINGS

A detailed description of the embodiments of the present technology is provided herein below, by way of example only, with reference to the accompanying drawings, in which.

Figure 1:
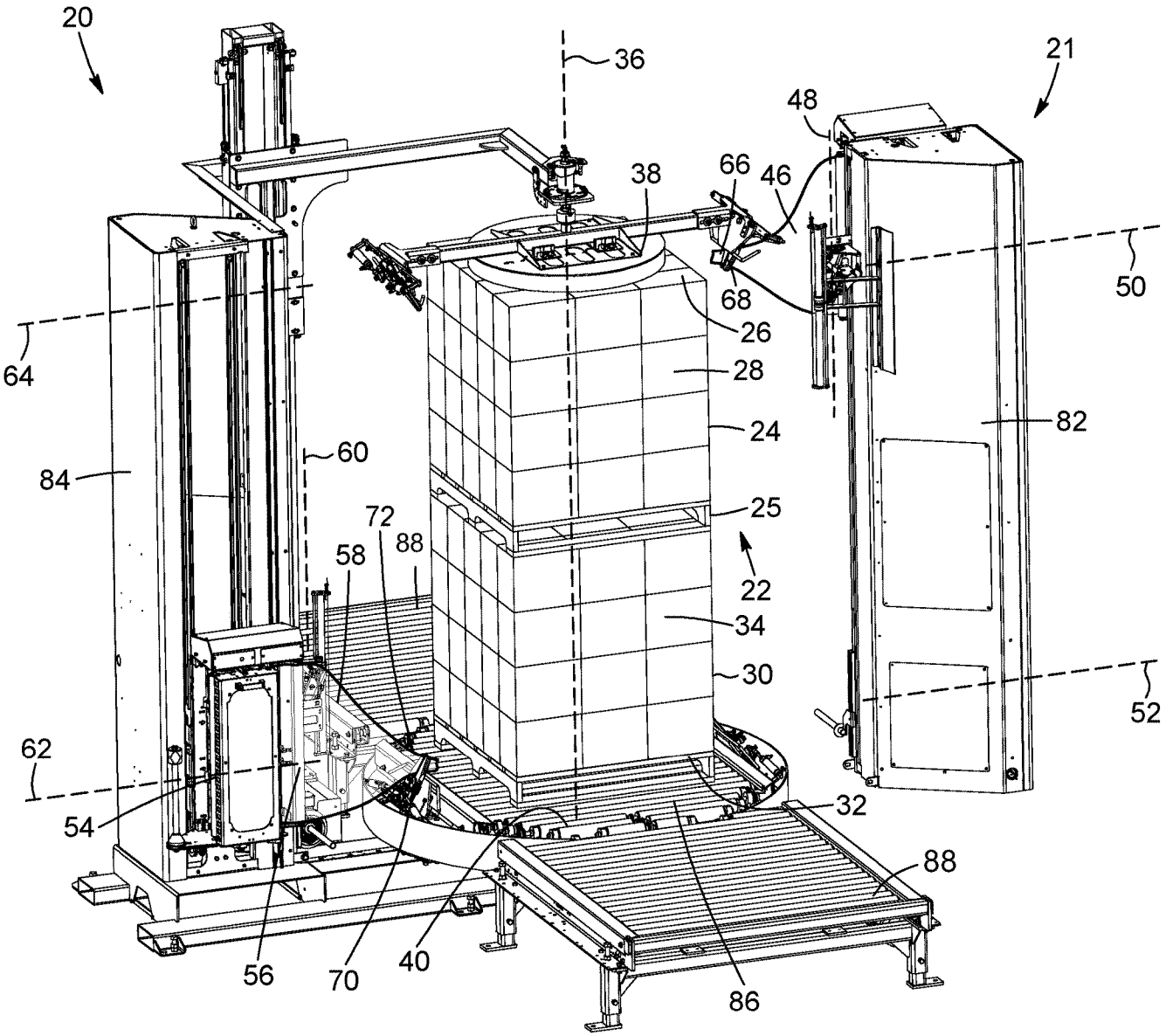
FIG. 1 is a perspective view of an apparatus for wrapping a load in accordance with an embodiment, the apparatus being configured at a beginning of a wrapping process wherein a first web retaining assembly holds a tail of a first material web, supplied by a first material dispenser, proximate an upper surface of the load and a second web retaining assembly holds a tail of a second material web, supplied by a second material dispenser, proximate a lower surface of the load and wherein the first and second material webs are spaced-apart from the load, i.e. they are not yet juxtaposed to the load.

In the drawings, embodiments of the technology are illustrated by way of examples. It is to be expressly understood that the description and drawings are only for the purpose of illustration and are an aid for understanding. They are not intended to be a definition of the limits of the technology.

DETAILED DESCRIPTION OF EMBODIMENTS

Before any variants, examples or embodiments of the wrapping apparatus and the associated wrapping method are explained in detail, it is to be understood that the wrapping apparatus and the associated wrapping method are not limited in its application to the details of construction and the arrangement of components set forth in the following description or illustrated in the drawings. Other variants or embodiments can be practiced or can be carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional suitable items. Unless specified or limited otherwise, the terms "mounted," "connected," "supported," and "coupled" and variations thereof are used broadly and encompass both direct and indirect mountings, connections, supports, and couplings and are thus intended to include direct connections between two members without any other members interposed therebetween and indirect connections between members in which one or more other members are interposed therebetween. Further, "connected" and "coupled" are not restricted to physical or mechanical connections or couplings. Additionally, the words "lower", "upper", "upward", "down" and "downward" designate directions in the drawings to which reference is made. Similarly, the words "left", "right", "front" and "rear" designate locations or positions in the drawings to which reference is made. The terminology includes the words specifically mentioned above, derivatives thereof, and words or similar import.

Figure 2:
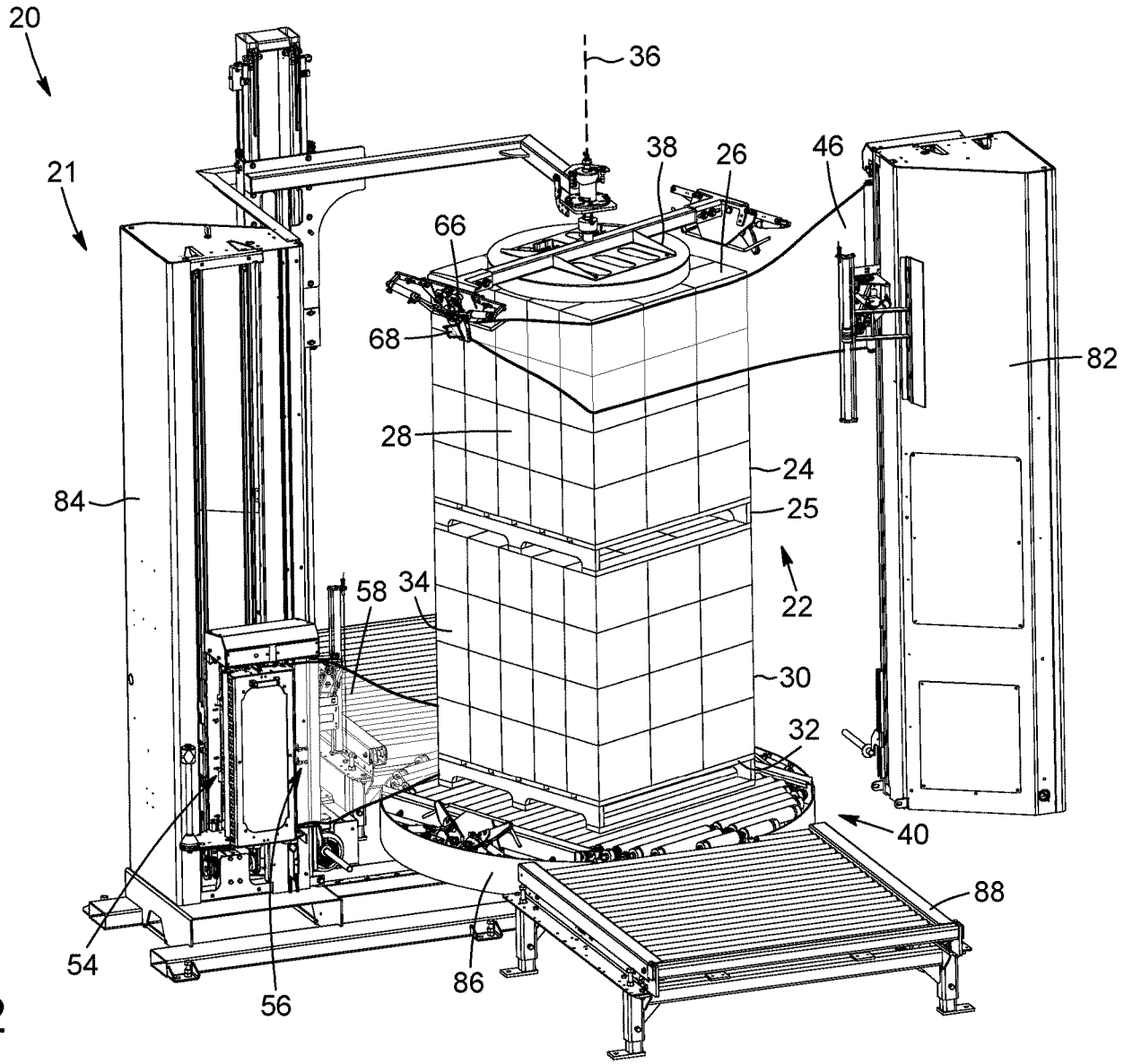
FIG. 2 is another perspective view of the wrapping apparatus shown in FIG. 1, the apparatus being configured in a subsequent step of the wrapping process wherein the first and the second material webs are respectively applied against an upper and a lower peripheral surfaces of the load to at least partially wrap the same.
Figure 3:
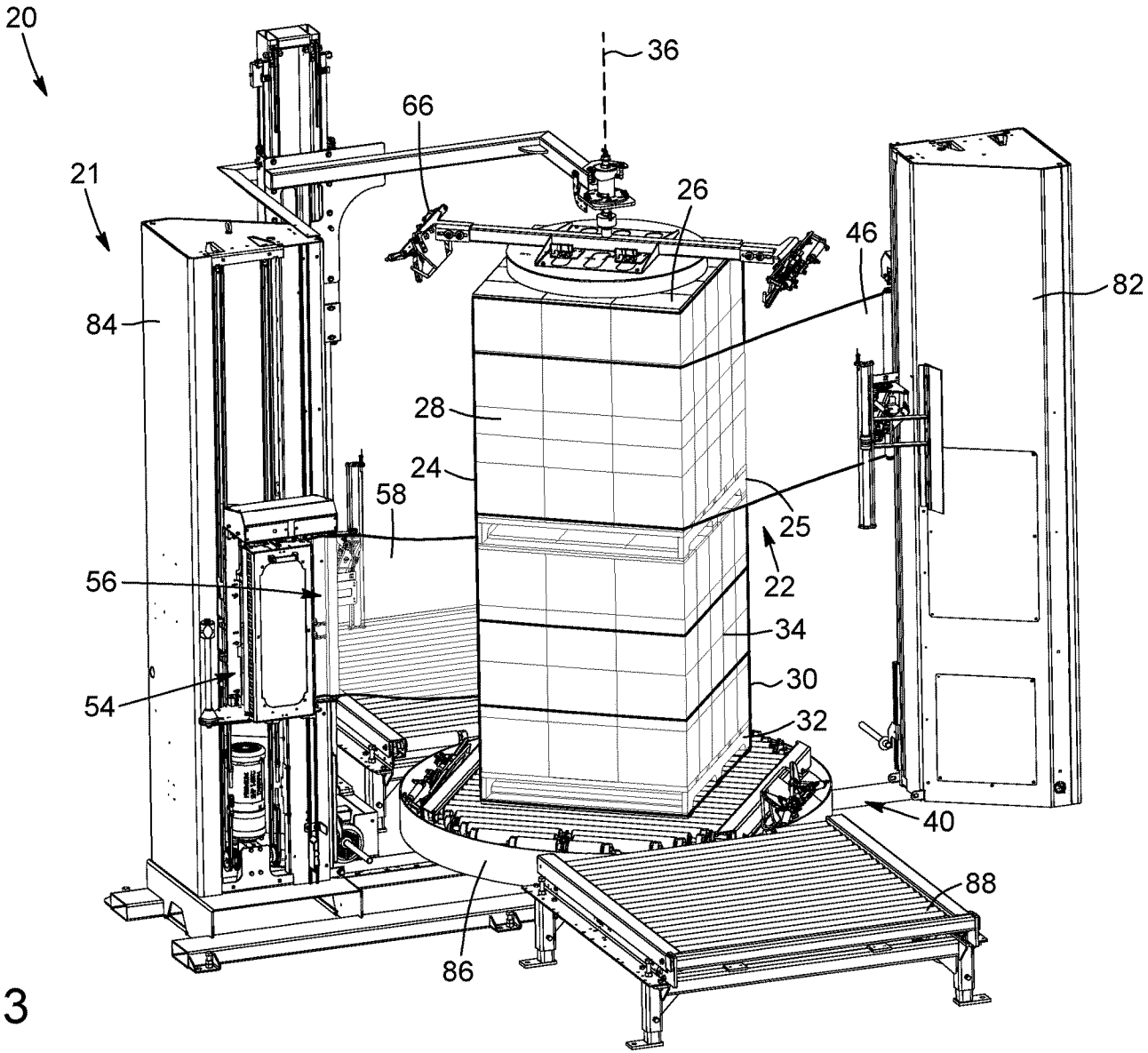
FIG. 3 is another perspective view of the wrapping apparatus shown in FIG. 1, the apparatus being configured in a subsequent wrapping step from FIG. 2, wherein the first and second material webs are respectively released from the first and the second web retaining assemblies, i.e. the first and the second web retaining assemblies no longer hold the tail of the first and the second web materials respectively, and wherein the first and the second material dispensers further supply the first and the second material webs to further cover the peripheral surface of the load.
Figure 4:
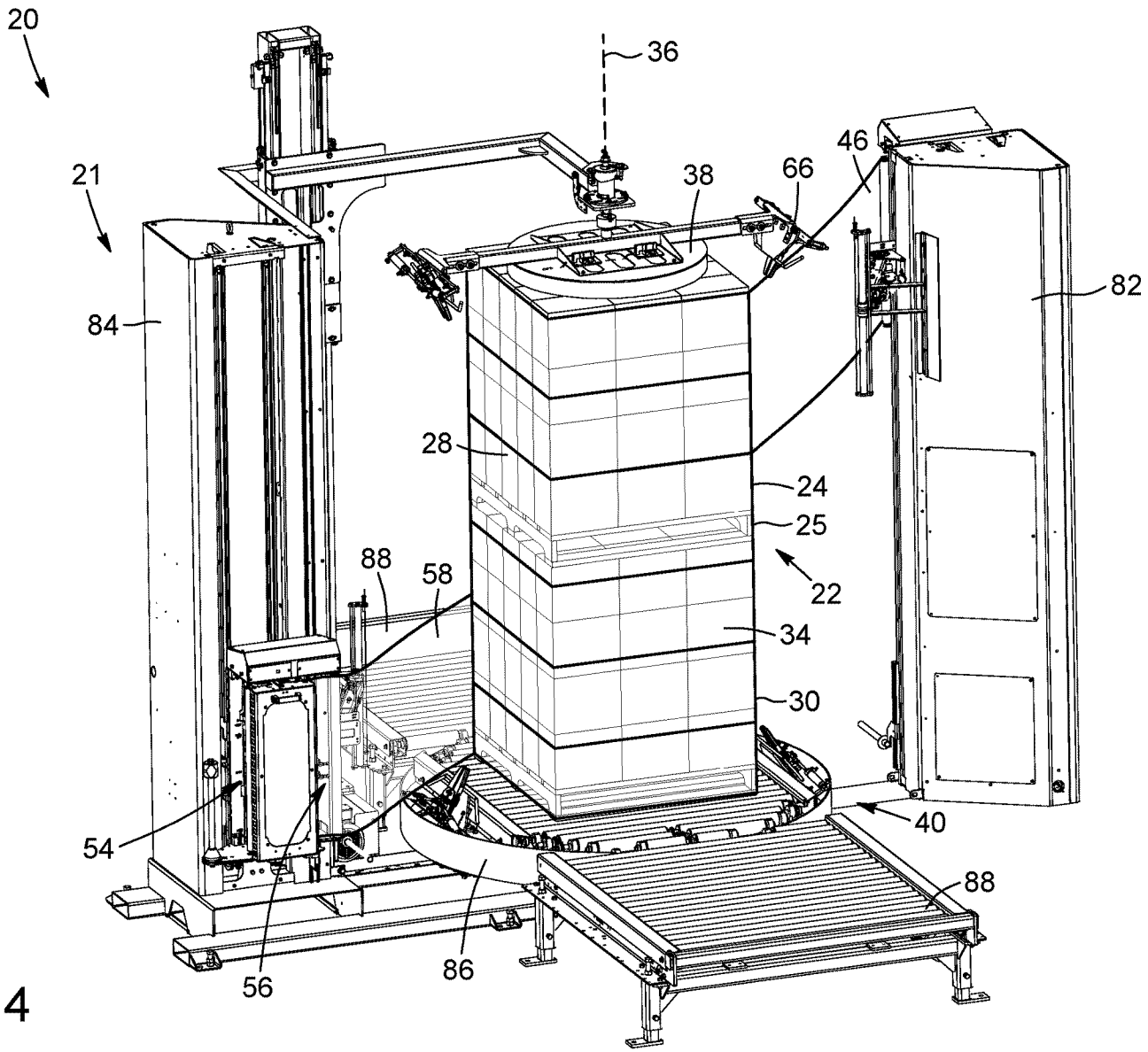
FIG. 4 is another perspective view of the wrapping apparatus shown in FIG. 1.
Figure 5:
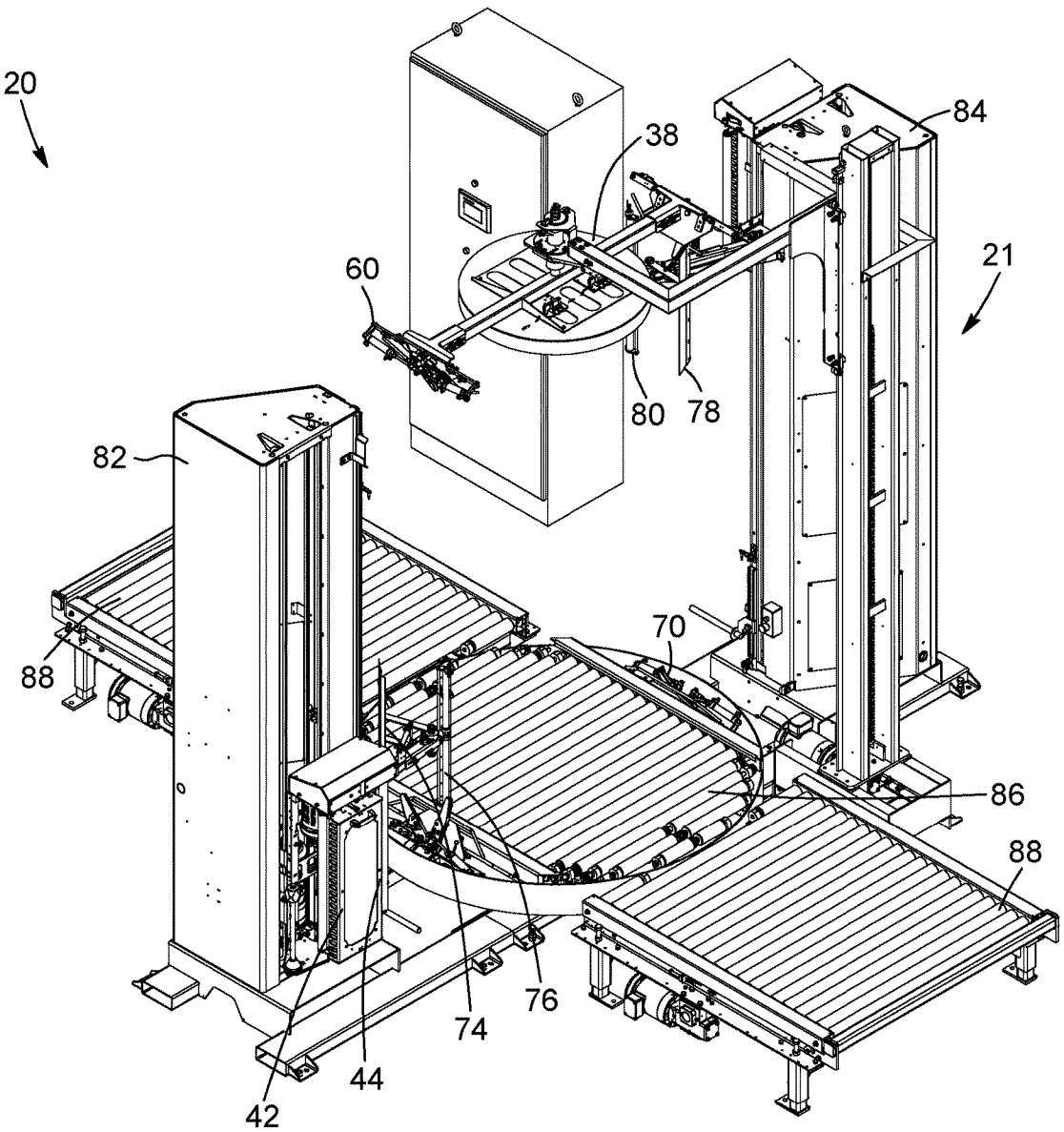
FIG. 5 is a perspective view of the wrapping apparatus shown in FIG. 1 where the load is omitted.
Figure 6:
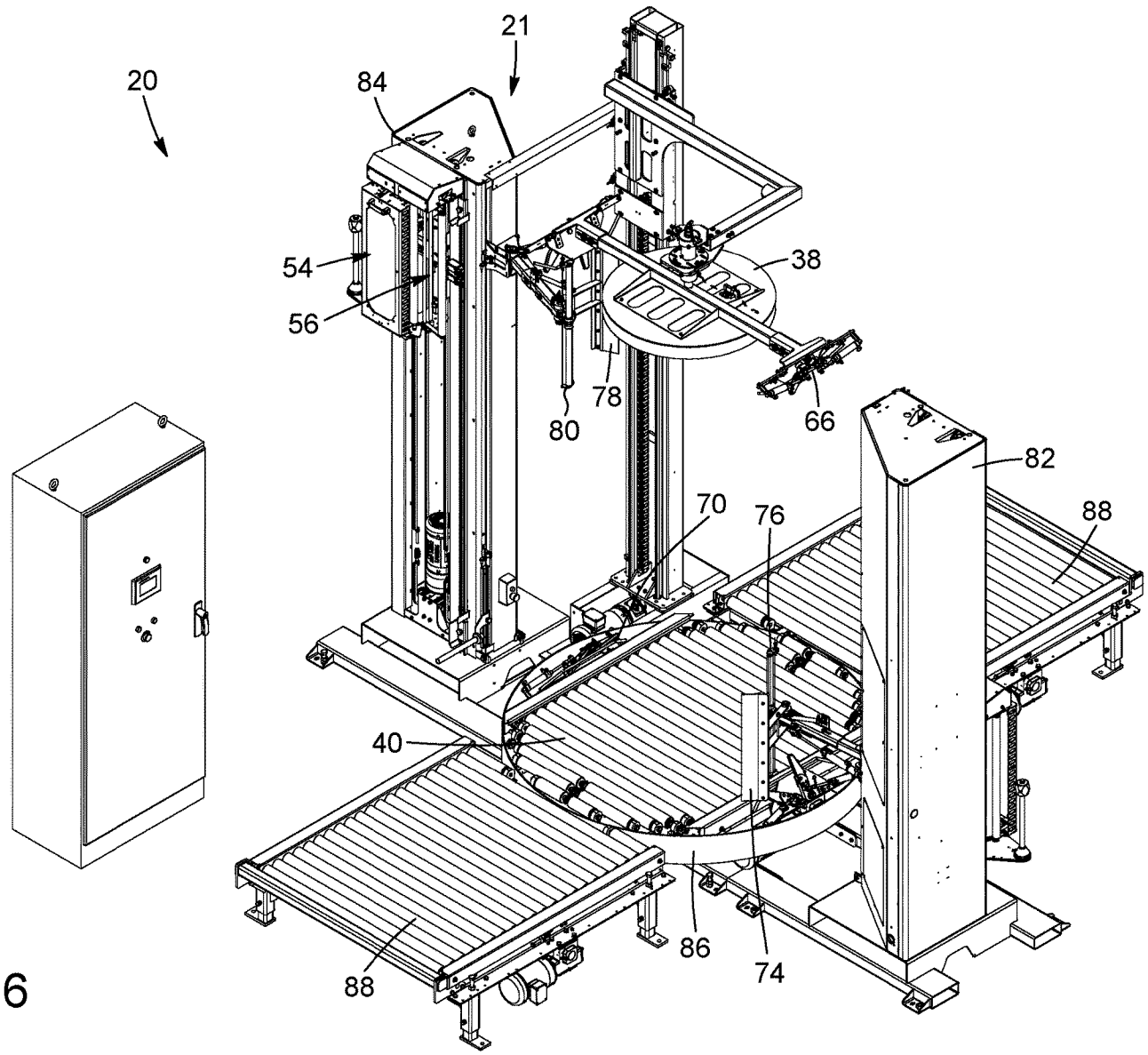
FIG. 6 is another perspective view of the wrapping apparatus shown in FIG. 5.
Figure 7:
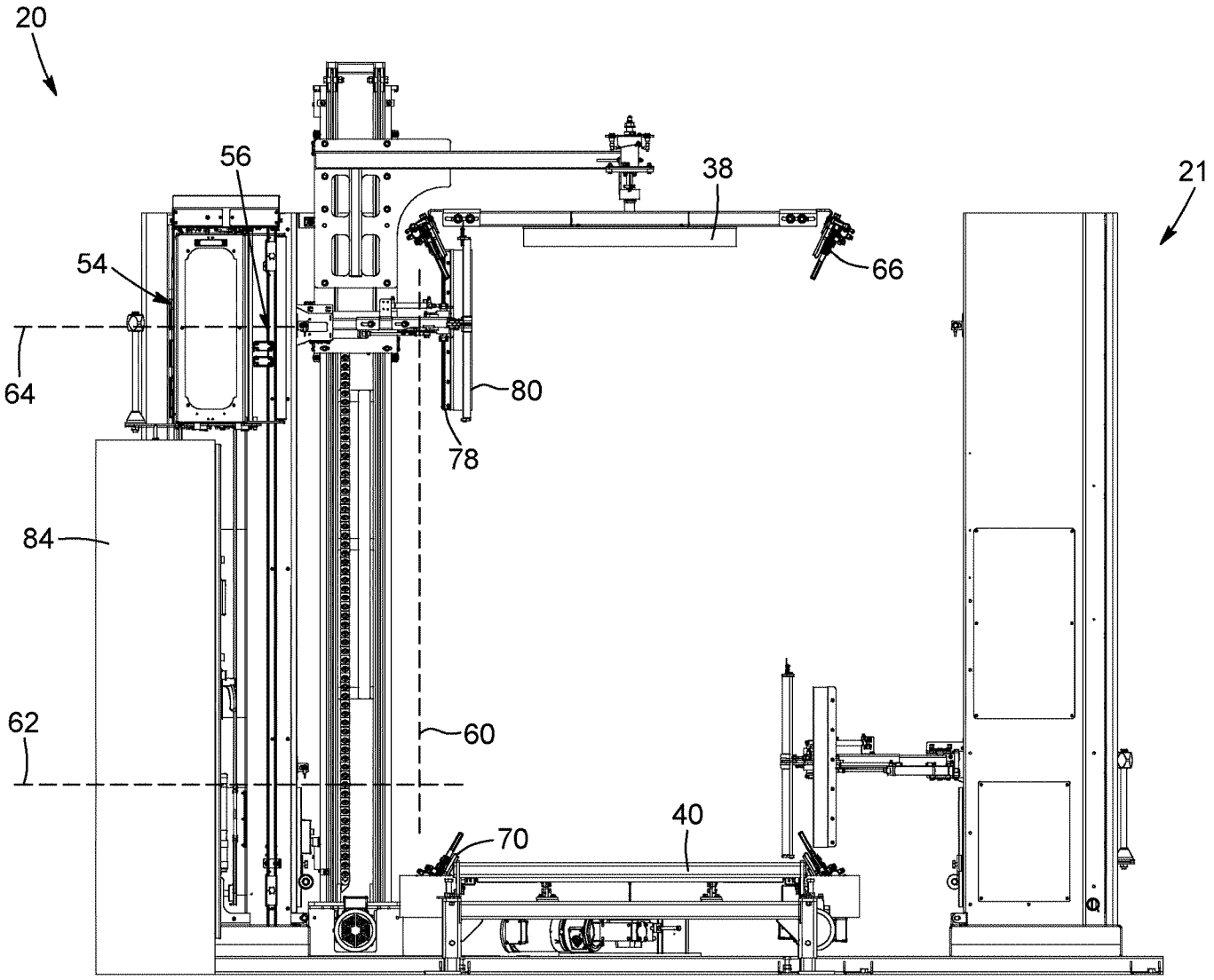
FIG. 7 is a front view of the wrapping apparatus shown in FIG. 5.
Figure 8:
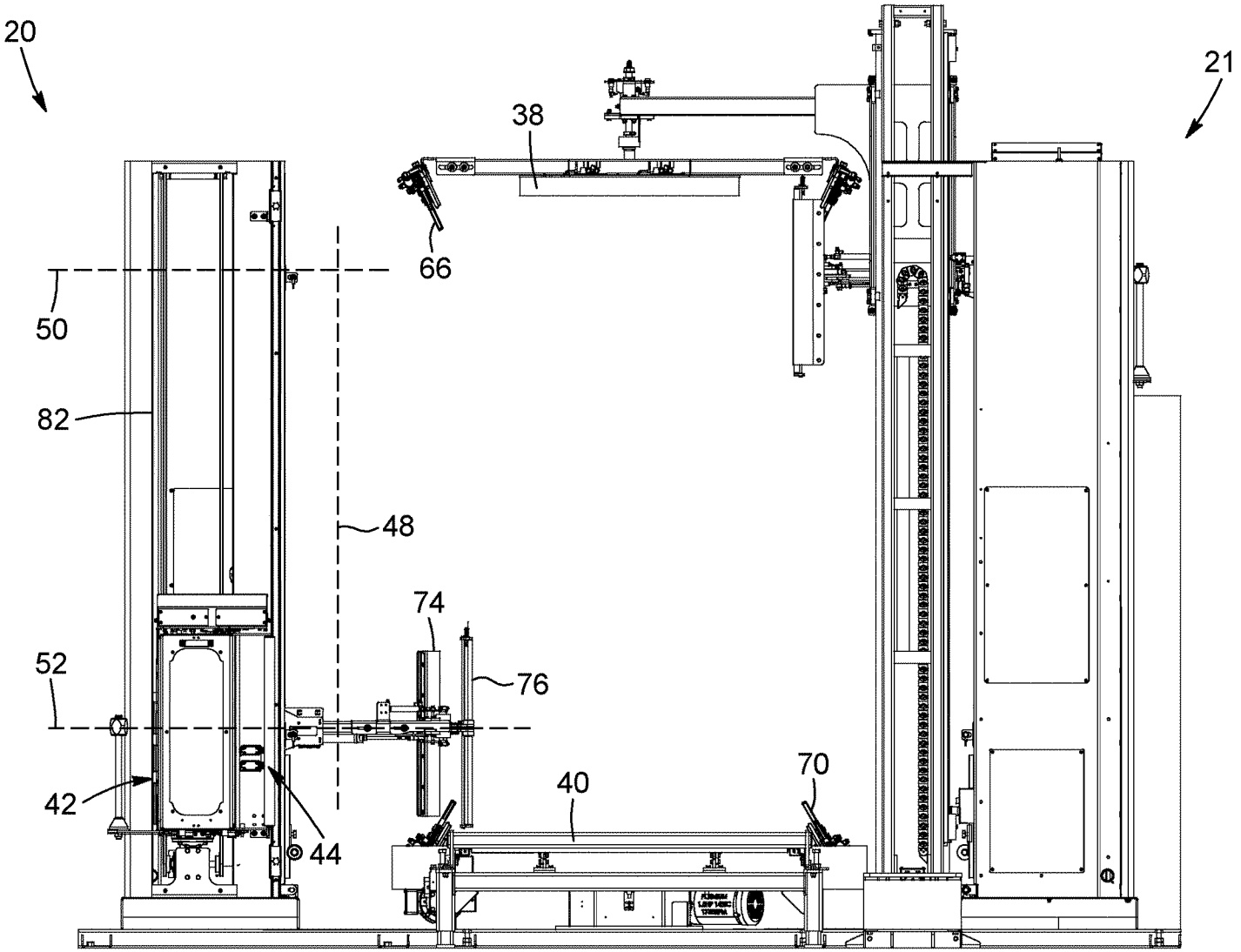
FIG. 8 is a rear view of the wrapping apparatus shown in FIG. 5.

Variants, examples and embodiments of the wrapping apparatus and the associated wrapping methods are described hereinbelow. Referring to FIGS. 1 to 8, there is provided an apparatus 20 for wrapping a load 22. The load 22 has an upper surface 26, located at an upper end, an upper portion 24 extending downwardly from the upper surface 26 and defining an upper peripheral surface 28, a lower surface 32, located at a lower end, a lower portion 30 extending upwardly from the lower end and meeting with the upper portion 24, defining a lower peripheral surface 34. The load 22 extends along a main (central) longitudinal axis 36 from the lower surface 32 to the upper surface 26, i.e. between the lower and the upper ends.

In a non-limitative embodiment, the upper and lower portions 24, 30 can meet at a midpoint or a midportion of the load 22 (sometimes referred to as a midportion position). However, in another embodiment, a length of the upper and lower portions 24, 30 can differ. For instance, one of the upper and lower portions can represent up to about 75% of a length of the load 22 and the other one, the remaining percentage.

In the non-limitative embodiment shown in FIGS. 1 to 4, the upper and the lower portions 24, 30 are separated by a pallet 25. It is appreciated that the pallet 25 could be replaced by another suitable load separator and/or load support/carrier. However, it is appreciated that, in an alternative embodiment (not shown), the upper and the lower portions 24, 30 can be directly mounted onto one another, i.e. without pallet or any other suitable load separator extending inbetween.

The apparatus 20 includes a load support 40 having a load-receiving surface for receiving the lower surface 32 of the load 22 and supporting the load 22.

In the non-limitative embodiment shown, the apparatus 20 also includes a load press 38 for contacting the upper surface 26 of the load 22. The load press 38 is vertically spaced-apart from the load support 40 in a manner such that the load 22 can be inserted inbetween. In the non-limitative embodiment shown, the load press 38 is embodied by a rotatable plate and, more particularly, by a circular shaped plate. The load press 38 is rotatable about a rotation axis extending parallel to the main longitudinal axis 36. In operation, the load press 38 is configured and adapted to apply a pressure against the upper surface 26 of the load 22, or at least abuts the upper surface 26 of the load 22. In the non-limitative embodiment shown, the load support 40 includes a turntable 86. The turntable 86 is rotatable about a rotation axis extending parallel to the main axis 36.

In the non-limitative embodiment shown, the wrapping apparatus 20 further includes two conveyors 88 for carrying the loads to the load support 40, such as the turntable 86, for being wrapped (referred to as an "upstream conveyor") and removing the loads from the load support 40, after the wrapping cycle (referred to as a "downstream conveyor").

The assembly including the load support 40 and both conveyors 88 define together a transversal conveying axis of the wrapping apparatus 20.

In the embodiment shown and as mentioned above, the load support 40 is rotatable about a rotation axis extending parallel to the main axis 36. However, in other embodiments, the load support 40 can be stationary, as will be described in more details below. Furthermore, it is appreciated that some embodiments of wrapping apparatuses can be free of load support 40.

The wrapping apparatus 20 further includes a dispenser frame 21, a first wrapping material dispenser 42, and a second material dispenser 54. The first and second wrapping material dispensers 42, 54 are mounted to and supported by the dispenser frame 21. More particularly, the first and second wrapping material dispensers 42, 54 are translatably mounted to the dispenser frame 21 and can translate about a translation axis extending parallel to the main axis 36.

In the embodiment shown, the dispenser frame 21 includes a first stationary dispenser support 82, defining a first support longitudinal axis 48, and a second stationary dispenser support 84, spaced-apart from the first dispenser support 82 and defining a second support longitudinal axis 60. In the non-limitative embodiment shown, each one of the first and second dispenser supports 82, 84 are located on a respective side of the load support 40. The first wrapping material dispenser 42 and the second wrapping material dispenser 54 are respectively mounted to the first dispenser support 82 and the second material dispenser 54. In the depicted embodiments, the main longitudinal axis 36 and the first and second support longitudinal axes 48, 60 are generally parallel one to another and are spaced apart from each other. In the illustrated embodiment, the first and the second longitudinal axes 48, 60 extend along a direction substantially parallel to the force of gravity. In the embodiment shown, the first and second wrapping material dispensers 42, 54 translate along the first and second support longitudinal axes 48, 60 respectively.

In the non-limitative embodiment shown, the load press 38 is connected to the dispenser frame 21 and, more particularly, it extends from the first dispenser support 82.

Thus, the first and the second material dispensers 42, 54 are aligned with and spaced-apart from the load support 40 and the first and second longitudinal axes 48, 60 are substantially perpendicular to the transversal conveying axis.

Each one of the first wrapping material dispenser 42 and the second wrapping material dispenser 54 comprises a roll support configured for supporting respectively a first packaging material supply 44 and a second packaging supply 56, from which a first material web 46 and a second material web 58 are supplied.

The first and the second material webs 46, 58 are generally a polymeric film dispensed in a web form. In some embodiments, the second material web 58 and the first material web 46 are made from the same material or polymer.

In the embodiment shown, the first material dispenser 42 is configured to be translatable along the first longitudinal axis 48 between a first starting position 50 and a first end position 52, defining inbetween a first wrapping path. In an embodiment, the first end position 52 is spaced apart from the first starting position 50. In some embodiments, the first starting position 50 is adjacent to the load press 38 and the first end position 52 is aligned with a junction of the upper and the lower portions 24, 30 of the load 22, which could be the midpoint or the midportion of the load 22.

In the embodiment shown, the second material dispenser 54 is configured to be translatable along the second longitudinal axis 60 between a second starting position 62 and a second end position 64, defining inbetween a second wrapping path. In an embodiment, the second end position is spaced apart the second starting position 62. In some embodiments, the second starting position 62 is adjacent to the load support 40 (or the lower surface 32 of the load 22) and the second end position 64 is aligned with the junction of the upper and the lower portions 24, 30 of the load 22, which could be the midpoint or the midportion of the load 22.

In other embodiments, the first end position 52 of the first material dispenser 42 can be aligned with the second starting position 62 of the second material dispenser 54 and vice-versa, i.e. the second end position 64 of the second material dispenser 54 can be aligned with the first starting position 50 of the first material dispenser 42. In these embodiments, the first material dispenser 42 translates from an uppermost position towards a lowermost position, whereas the second material dispenser 54 translates from a lowermost position towards an uppermost position.

It is appreciated that, in still another alternative embodiment, the first and second starting positions 50, 62 can be located adjacent to the midportion of the load 22. In another alternative embodiment, the first starting position 50 and the first end position 52 can be at a same height, i.e. for instance adjacent to the uppermost or the lowermost position. Similarly, the second starting position 62 and the second end position 64 can also be at a same height. Thus, the first starting position 50, the first end position 52, the second starting position 62, and the second end position 62 can be located anywhere along the height of the dispenser frame 21 provided that the first and second material dispenser 42, 54 are translated vertically along the first and the second wrapping paths during the wrapping cycle to wrap at least a portion of the peripheral surface of the load 22.

The first and the second starting positions 50, 62 and the first and second end positions 52, 64 can be referred to in terms of the position of the respective one of the first and second material dispenser 42, 54 along the dispenser frame 21, for instance along the first and second dispenser supports 82, 84, or in terms of the position of the first and second material webs 46, 58 being applied along the load 22 with respect to the main longitudinal axis 36. In either case, the positions are vertically aligned with respect to the main longitudinal axis 36 and all axes extending parallel thereto.

In all embodiments, both the first and the second material webs 46, 58 at least partially cover and wrap the load 22 (i.e., at least the upper peripheral surface 28 and at least the lower peripheral surface 34 are respectively covered by one of the first and the second material webs 46, 58). In some embodiments, the first and second material webs 46, 58 cross one another at a junction of the upper and the lower portions 24, 30 of the load 22 (e.g., the midportion), i.e. the first web material 46 at least partially covers the lower peripheral surface 34 of the load 22 and the second web material 58 at least partially covers the upper peripheral surface 28 of the load 22. As such, there might be an overlap of the first and second material webs 46, 58 over at least a portion of the peripheral surface of the load 22 in proximity of the junction of the upper and the lower portions 24, 30 of the load 22. In some embodiments, both the first and second material webs 46, 58 cover an entire peripheral surface of the load 22, i.e. the upper and the lower peripheral surfaces 28, 34 and the first and second material webs 46, 58 overlap an entire peripheral surface of the load 22.

The wrapping apparatus 20 further includes a first web retaining assembly 66 and a second web retaining assembly 70. The first web retaining assembly 66 and the second web retaining assembly 70 are configured for gripping/holding respectively a tail 68 of the first material web 46 and a tail 72 of the second material web 58. In the non-limitative embodiment shown, the first web retaining assembly 66 is mounted to the load press 38 such that, in use, the first web retaining assembly 66 is adjacent to the top surface 26 of the load 22. The second retaining member 70 is mounted to the load support 40, i.e. the turntable 86, in the non-limitative embodiment shown, such that, in use, the second web retaining assembly 70 is adjacent to the lower surface 32 of the load 22.

In the non-limitative embodiment shown, each one of the first and the second web retaining assemblies 66, 70 includes web seizing clamps. For instance, the web seizing clamps of the retaining assemblies 66, 70 can be aligned substantially horizontally.

The abovementioned mentioned elements and components are configured such that, when the wrapping apparatus 20 is in use, prior to and at a beginning of a wrapping cycle, the first web retaining assembly 66 grips or holds the tail 68 of the first material web 46 when the first material supply 44 starts wrapping the load 22 (i.e., the first material web 46 is first dispensed from the first material supply 44) along the upper peripheral surface 28 of the load 22. Once the first material web 46 is secured to the load peripheral surface 28, i.e. after at least one revolution or after two or more relative rotation between the load 22 and the first and second material dispensers 42, 54, the first web retaining assembly 66 can release the first material web 46, i.e. it no longer holds the tail 68, and the first material dispenser 42 then continues wrapping the load 22 such that the first material web 46 at least covers the upper portion 24 of the load 22. Similarly, the second web retaining assembly 70 grips or holds the tail 72 of the second material web 58, at the beginning of the wrapping cycle, when the second material supply 56 starts wrapping the load 22 along the lower peripheral surface 34 of the load 22. Once the second material web 58 is secured to the load peripheral surface 34, the second web retaining assembly 66 can release the first material web 46, i.e. it no longer holds the tail 72, and the second material supply 56 then continues wrapping the load 22 such that the second material web 58 at least covers the lower portion of the load 22.

It is to be noted that the first material 46 and the second material web 58 could either be simultaneously or sequentially dispensed on a respective portion of the load 22. In some embodiments, the first and the second web material webs 46, 58 are dispensed simultaneously for at least a portion of the wrapping cycle and, in some embodiments, during a majority of the wrapping cycle. Therefore, the first and the second material dispensers 42, 54 operate simultaneously during at least a portion of the wrapping cycle and, in some embodiments, during a majority of the wrapping cycle. For instance, the first material dispenser 42 and the second material dispenser 54 can be configured and operated to respectively wrap the upper peripheral surface 28 and the lower peripheral surface 34 at the same time, i.e. simultaneously. Alternatively, the second material dispenser 54 could being wrapping before or after the first material dispenser 42, or vice-versa. It will be readily understood that when the first material dispenser 42 and the second material dispenser 54 are simultaneously operated for at least a portion of the wrapping cycle, the time required to wrap the load 22, i.e. a duration of the wrapping cycle, can be reduced. In one non-limitative embodiment, such a configuration can allow to reduce the amount of time required to wrap the load 22 by a factor two, i.e., the apparatus 20 can be, in some embodiments, twice as fast for the same surface of material web applied to the load.

In some embodiments, the first material dispenser 42 wraps the load 22 along the first wrapping path, i.e. from the first starting position 50 to the first end position 52, during the wrapping cycle. At the first end position 52, no further first material web 46 is applied against the peripheral surface of the load 22. At the first end position 52, a length of the first web material wrapped against the peripheral surface of the load 22 is separated from the first material supply 44 by cutting the first material web 46. Similarly, the second material dispenser 54 wraps the load 22 along the second wrapping path, i.e. from the second starting position 62 to the second end position 64, during the wrapping cycle. At the second end position 64, no further second material web 56 is applied against the peripheral surface of the load 22. At the second end position 64, a length of the second web material wrapped against the peripheral surface of the load 22 is separated from the second material supply 56 by cutting the second material web 58.

In some embodiments, the apparatus 20 also includes a first web guide 74, a first web cutter 76, a second web guide 78, and a second web cutter 80, which can be mounted to the dispenser frame 21. The first web guide 74 and the second web guide 78 can cooperate respectively with the first and the second material dispensers 42, 54 for guiding respectively the first and the second material webs 46, 58 from the first and the second material dispensers 42, 54 towards the load 22. The first web cutter 76 and the second web cutter 80 can be mounted near or to the first and the second web guides 74, 78 respectively. The first guide 74 and the first web cutter 76 can be movable towards the load 22, so as the first and the second material webs 46, 58 can be cut at the end of the wrapping cycle, i.e. at the first and the second end positions. In an embodiment, the first web cutter 76 and the first web guide 74 can be displaced simultaneously towards and away from the load 22. Similarly, the second web cutter 80 and the second web guide 74 can be displaced simultaneously towards and away from the load 22.

In some embodiments, each one of the first web guide 74 and the second web guide 78 includes a pair of longitudinal guiding arms, which can be spaced-apart from one another, for receiving therebetween the first and the second material webs 46, 58 respectively.

During the wrapping cycle, relative rotation between the load 22 and the first and the second material dispensers 42, 54 is provided to wrap the peripheral surface of the load 22 with the first and second material web 46, 58. In the embodiment shown, the load 22 is supported by the load support 40, such as the turntable 88, which rotates about a hub (not shown). In some embodiments, the first and second material webs 46, 58 are wrapped around the load 22 when the load press 38 (e.g., the plate) and the load support 40 both rotate in a same direction.

One skilled in the art will appreciate that the relative rotation between the load 22 and the first and the second material dispensers 42, 54 can be provided by other means than the turntable assembly shown in the accompanying drawings. For instance, and without being limitative, the dispenser frame 21 can include a rotating arm assembly on which the first and the second material dispensers 42, 54 are translatably mounted and revolution around the load 21 during the wrapping cycle. In such embodiment, the load 22 can be supported on a load support.

For instance, and without being limitative, the dispenser frame 21 can include a first and a second rotating arms engageable in rotation about the load 22 and the load 22 can be stationary. Each of the first and the second rotating arms can have a respective one of the first and the second material dispensers mounted thereto and translatable therealong. Therefore, the relative rotation between the load 22 and the first and the second material dispensers can be provided by rotating the dispensers around the load 22. In an embodiment, the first and the second rotating arms can be mounted to different rotatable frame assemblies and rotate in a same direction (e.g., clockwise direction or counterclockwise direction). In another embodiment, the first and the second rotating arms can be mounted to a ring member and can be engaged in rotation around the load 22 by being displaced along the ring member or by engaging the ring member in rotation. In an embodiment, the ring member is stationary in height and each one of the first and the second material dispensers translate independently along its respective first and second rotating arms.

It is appreciated that when the load 22 remain stationary during the wrapping cycle, the load press can be omitted. Similarly, the load support 40 can be omitted. In an embodiment, if one of the load press and the load support is omitted, the web retaining assemblies can be mounted to the dispenser frame 21 and, for instance, adjacent to the first and the second starting positions respectively.

The other features and/or components of the embodiment using first and a second rotating arms engageable in rotation about the load 22 are essentially similar to the ones described above wherein the first and the second material dispensers 42, 54 are mounted to the first stationary dispenser support 82 and the second stationary dispenser support 84 and translate therealong and relative rotation is provided through the rotation of the load support 40 with respect to the first and the second stationary dispenser supports 82, 84. In the present embodiment, the first and the second material dispensers 42, 54 are mounted to the first and the second rotating arms and translate therealong and relative rotation is provided through the revolution of the rotating arms about the stationary load 22.

During the wrapping cycle performed by the apparatus 20, the first wrapping path defined between the first starting position and the first end position can extend from an uppermost position, at a height corresponding substantially to the upper surface 26 of the load 22, to a junction between the upper and the lower portions 24, 30 of the load 20. In this embodiment, the second wrapping path defined between the second starting position and the second end position can extend from a lowermost position, at a height corresponding substantially to the lower surface 32 of the load 22, to the junction between the upper and the lower portions 24, 30 of the load 20. In this embodiment, the load 22 is wrapped without overlap of the first and the second web materials 46, 58.

In another embodiment, during the wrapping cycle performed by the apparatus 20, the first wrapping path defined between the first starting position and the first end position can extend from an uppermost position, at a height corresponding substantially to the upper surface 26 of the load 22, to a lowermost position, at a height corresponding substantially to the lower surface 32 of the load 22. In this embodiment, the second wrapping path defined between the second starting position and the second end position can extend from the lowermost position to the uppermost position or from the uppermost position to the lowermost position. In this embodiment, the load 22 is wrapped with an overlap of the first and the second web materials 46, 58 extending along an entire height of the load 22, i.e. between the upper surface 26 and the lower surface 32.

Several alternative embodiments can be foreseen wherein at least one of the first and the second starting positions can be located at the junction between the upper and the lower portions 24, 30 of the load 20, wherein the first and the second starting positions are located at a same position along the main longitudinal axis 36, wherein the corresponding starting and end positions are located at a same position along the main longitudinal axis 36, and others.

The displacement of the first and second material dispensers 42, 54 along their first and second wrapping paths respectively can be sequentially, simultaneously during a portion of the wrapping cycle, during a majority of the duration of the wrapping cycle, essentially during the entire wrapping cycle or during the entire wrapping cycle.

In sequential wrapping cycle, the first starting position and the second starting position can be identical to the first starting position and the second starting position of the previous wrapping cycle, i.e. the first and second material dispensers 42, 54 returns to their previous starting positions or the first starting position corresponding to the first end position and the second starting position corresponds to the second end position. In another embodiment, the first starting position and the second starting position can be different from the first starting position and the second starting position of the previous wrapping cycle, i.e. the new wrapping cycle begins where the previous wrapping cycle ended.

It is understood that the above embodiments and examples of the apparatus which have been described above may be used in various methods for wrapping the load. Different embodiments of such methods will now be described.

In accordance with one aspect, there is provided a method for wrapping a load, the load being similar to the one which has been previously described.

The method includes configuring the first material dispenser including the first material web in the first starting position and the second material dispenser including the second material web in the second starting position. The first starting position can be, in some embodiments, spaced-apart from the second starting position. In some embodiments, the first starting position of the first material dispenser is the uppermost position, adjacent to the top surface of the load, and the second starting position of the second material dispenser is the lowermost position, adjacent to the lower surface of the load. Alternatively, the first and the second starting positions can be either the lowermost position or the uppermost position for both material dispensers. The first starting position and/or the second starting position could also be the junction of the upper and the lower portions of the load, which could be midpoint or the midportion of the load, or any other intermediate positions of the upper portion or the lower portion of the load, as it has been described above.

The method also includes providing a relative rotation between the load, the first material dispenser and the second material dispenser during the wrapping cycle, such that, upon the relative rotation, the first and the second material dispensers at least partially wrap the peripheral surface of the load. In an embodiment, the first and the second material dispensers wrap the peripheral surface of the load simultaneously during at least a portion of the wrapping cycle. In an embodiment, the first material dispenser at least partially wraps the upper peripheral surface of the load with the first material web and the second material dispenser at least partially wraps the lower peripheral surface of the load with the second material web. In this scenario, the first material dispenser wraps the upper peripheral surface of the load simultaneously while the second material dispenser wraps the lower peripheral surface of the load during at least a portion of the wrapping cycle.

In some embodiments, the method includes a step of gripping and holding the tail of the first material web with the first web retaining assembly and the tail of the second material web with the second web-retaining assembly before beginning the wrapping cycle and at the beginning of the wrapping cycle. In some embodiments, this step includes holding the tail of the first and the second material web and wrapping the peripheral surface of the load until at least the first and the second material webs are secured to the load.

One would have readily understood that the relative rotation mentioned above can be imparted using techniques, devices, apparatuses or methods already known in the art. For example, the relative rotation of the load can be imparted by the rotation of the load support, such as a turntable, on which the load can be mounted. In another example, the relative rotation can be imparted by the rotation of the first and second material dispensers around the load. Different configurations to achieve relative rotation of the load with respect with a material dispenser have been previously described and other configurations are already known in the art. In some embodiments, holding or gripping the tail of the first material web and holding or gripping the tail of the second material web can be performed simultaneously or nearly simultaneously, and continue until the first material web at least partially covers the upper peripheral surface and the second material web at least partially covers the lower peripheral surface. In some embodiments, the method includes applying or pressing the first material web and the second material web against the load. The method can include guiding the first material web and/or the second material web towards the load during their application against the load.

The method can also include ending the wrapping cycle when the first material dispenser and the second material dispenser respectively reach the first end position and the second end position.

Once the abovementioned steps are carried out, the method can include releasing the tail of the first material web when the load is sufficiently wrapped by the first material web and releasing the tail of the second material web when the load is sufficiently wrapped by the second material web. In some embodiments, ending the wrapping cycle includes cutting the first and/or second material webs. In some embodiments, ending the wrapping cycle also includes securing the first and/or the second material webs to the wrapped load when the first and/or the second material dispensers reached respectively the first and the second end positions. For instance, for securing the first and/or the second material webs to the wrapped load, a layer of the first material web and the second material web may be heated, treated and/or glued to a preceding layer of the first material web and the second material web, i.e. to the wrapped load, either prior to or after the cutting step, such that the layer of the first material web and the second material web stick or adhere to the preceding layer (i.e., the layer being underneath). Such a step allows the first and second material web to be properly fixed to the load, which may in turn facilitate the handling and/or of the wrapped load.

These arrangements can be useful for wrapping a stacked load, which can be embodied by the non-limitative example of a double-stacked pallet. When the load is a double-stacked pallet, the first material dispenser can be associated with a first pallet (e.g., bottom pallet) while the second material dispenser can be associated with a second pallet (e.g., top pallet). In these embodiments, the lower portion of the load can be the first pallet and the upper portion of the load can be the second pallet, superposed to the first pallet. As such, the first and second material dispensers can be configured to wrap a corresponding one of the first and second pallets of the double-stacked pallet. The double-stacked pallet can be subsequently separated into two individual pallets, for example during the handling of the load, according to steps already known in the art. In a nonlimitative embodiment, the wrapped load includes no web overlap between the first material web and the second material web. For example, and without being limitative, once positioned, the first and second material dispensers are configured for supplying the first material web and the second material web, the corresponding material supply of the first material dispenser can supply the first material web to a respective portion of the load, for example the upper peripheral surface or an upper pallet, and the corresponding material supply of the second material dispenser can supply the second material web to a respective portion of the load, for example the lower peripheral surface or a lower pallet.

One would readily understand that the sequence being performed for wrapping the upper peripheral surface and the lower peripheral surface can vary depending on the first starting position and the second starting position. For example, when the first starting position of the first material dispenser is the uppermost position and the second starting position of the second material dispenser is the lowermost position, the first and second material dispensers are configured to dispense the first and second material webs on a respective one of the upper and lower peripheral surfaces of the load. More specifically, upon relative rotation of the load, the first material dispenser is configured to supply the first material web and wrap the upper peripheral surface of the load and the second material dispenser is configured to supply the second material web and wrap the lower peripheral surface of the load. In this example, the relative rotation of the load allows to simultaneously wrap the lower portion and the upper portion of the load during at least portion(s) of the wrapping cycle. It is to be noted that this sequence would change if the starting positions of the first and second wrapping material dispensers change.

For a subsequent wrapping cycle, the first and material dispensers can either be configured to move back to their respective starting position or remain at their respective ending position of the previous wrapping cycle. For example, and without being limitative, if the first and second material dispensers end the wrapping cycle at the junction of the upper and the lower portions, for instance, in the midportion position, they could either move back to their respective starting position or start the subsequent wrapping cycle at the junction of the upper and the lower portions, instead of moving back from the end positions to their respective starting position. As such, in these embodiments, the end positions of a previous wrapping cycle can be the starting positions of a subsequent wrapping cycle. The subsequent wrapping cycle can either be performed on the same load, for example to provide additional layers of material web to the load or can be performed on a different load. It will be readily understood that the load can be wrapped in one or more layers of packaging material. The number of layers generally depends on different characteristics of the load, such as, but not limited to its dimensions, sizes, weight, transport conditions, or any other properties that may be relevant to the wrapping of the load.

In accordance with another aspect, there is provided an alternative method for wrapping a load, the load being similar to the one which has been previously described.

The method includes positioning the first material dispenser including the first material web at the first starting position and the second material dispenser including the second material web at the second starting position. This step is similar to the step of configuring the first material dispenser and the second material dispenser which has been previously described. As indicated above, the first starting position can be spaced apart from the second starting position.

The method also includes providing a relative rotation between the load, the first material dispenser and the second material dispenser during a wrapping cycle.

The method includes translating, during the wrapping cycle, the first material dispenser from the first starting position towards the first end position and the second material dispenser from the second starting position towards the second end position, such that, upon the relative rotation, the first material web at least partially overlaps with the second material web during at least a portion of the wrapping cycle. In some embodiments, the first end position may be aligned with the second starting position, i.e., the first end position can be located at the same height (with respect to the load) than the second starting position. In some embodiments, the alignment occurs near or at the junction between the upper and the lower portions of the load, for instance at the midportion of the load, or, alternatively, elsewhere along the height of the load. In some embodiments, the first material web can partially overlap with the second material web close to the junction between the upper and the lower portions of the load. In this arrangement, in use, the first and second material dispensers are translated along a substantially vertical direction, i.e., the first support longitudinal axis of the first stationary dispenser support and the second support longitudinal axis of the second stationary dispenser support both extending along a direction substantially parallel to the main longitudinal (central) axis. These translational movements of the first and second material dispensers during the relative rotation of the load allow to spirally wrap the load. More particularly, during the translation and relative rotation of the first and the second material dispensers with respect to the load, the first and the second material webs re dispensed and wrapped wound the load following a pattern following the shape of a spiral. As mentioned above, it is to be noted that the translation and the rotation of the first and second material dispensers can be simultaneous or sequential. Each one of the first and second material dispensers hence supplies a spirally wounded material web around the load, and, in some embodiments, the first material web at least partially overlaps with the second material web during at least a portion of the wrapping cycle.

In some embodiments, the method includes holding the tail of the first material web with the first web retaining assembly and the tail of the second material web with the second web-retaining assembly before providing the relative rotation and at the beginning of the wrapping cycle. This step is similar to what has been previously described.

As for the above-described embodiments and without being limitative, the first starting position can be the uppermost position and the first end position can be the lowermost position and the second starting position can be the second lowermost position and the second end position can be the second uppermost position.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. An apparatus for wrapping a load with a first web material and a second web material, the load comprising an upper portion having an upper surface and defining an upper peripheral surface and a lower portion having a lower surface and defining a lower peripheral surface, the apparatus comprising:

a dispenser frame having a first starting position, a first end position, a second starting position, and a second end position, wherein the first starting position is associated with a first height, the second starting position is associated with a second height, the first height being different than the second height;

a first wrapping material dispenser mounted to the dispenser frame and being vertically translatable therealong and along a first wrapping path extending between the first starting position and the first end position, the first wrapping material dispenser being configured to at least partially wrap the upper peripheral surface of the load with the first web material upon a relative rotation between the load and the first wrapping material dispenser during a wrapping cycle;

a second wrapping material dispenser mounted to the dispenser frame and being vertically translatable therealong and along a second wrapping path extending between the second starting position and the second end position, the second wrapping material dispenser being configured to at least partially wrap the lower peripheral surface of the load with the second web material upon a relative rotation between the load and the second wrapping material dispenser during the wrapping cycle;

a first web retaining assembly adjacent to the first starting position to hold a tail of the first web material; and a second web retaining assembly adjacent to the second starting position to hold a tail of the second web material.

2. The apparatus of claim 1, wherein the first starting position is spaced-apart from the first end position and the second starting position is spaced apart from the second end position.

3. The apparatus of claim 1, wherein the first wrapping path extends in the upper portion of the load and the second wrapping path extends in the lower portion of the load.

4. The apparatus of claim 1, wherein the first wrapping path and the second wrapping path at least partially overlap.

5. The apparatus of claim 1, wherein the dispenser frame comprises a first stationary dispenser support supporting the first wrapping material dispenser and a second stationary dispenser support, spaced-apart from the first dispenser support, and supporting the second wrapping material dispenser.

6. The apparatus of claim 1, wherein the dispenser frame comprises a first rotating arm supporting the first wrapping material dispenser and a second rotating arm supporting the second wrapping material dispenser, the first and the second rotating arms being engageable in rotation about the load during the wrapping cycle.

7. An apparatus for wrapping a load with a first web material and a second web material, the load comprising an upper portion having an upper surface and defining an upper peripheral surface and a lower portion having a lower surface and defining a lower peripheral surface, the apparatus comprising:

a dispenser frame having a first starting position, a first end position, a second starting position, and a second end position, wherein the first starting position is vertically spaced apart from the second starting position;

a first wrapping material dispenser mounted to the dispenser frame and being vertically translatable therealong and along a first wrapping path extending between the first starting position and the first end position, the first wrapping material dispenser being configured to at least partially wrap the upper peripheral surface of the load with the first web material upon a relative rotation between the load and the first wrapping material dispenser during a wrapping cycle;

a second wrapping material dispenser mounted to the dispenser frame and being vertically translatable therealong and along a second wrapping path extending between the second starting position and the second end position, the second wrapping material dispenser being configured to at least partially wrap the lower peripheral surface of the load with the second web material upon a relative rotation between the load and the second wrapping material dispenser during the wrapping cycle;

a first web retaining assembly adjacent to the first starting position to hold a tail of the first web material; and a second web retaining assembly adjacent to the second starting position to hold a tail of the second web material.

8. The apparatus of claim 7, wherein the first starting position is spaced-apart from the first end position and the second starting position is spaced apart from the second end position.

9. The apparatus of claim 7, wherein the first wrapping path extends in the upper portion of the load and the second wrapping path extends in the lower portion of the load.

10. The apparatus of claim 7, wherein the first wrapping path and the second wrapping path at least partially overlap.

11. The apparatus of claim 7, wherein the dispenser frame comprises a first stationary dispenser support supporting the first wrapping material dispenser and a second stationary dispenser support, spaced-apart from the first dispenser support, and supporting the second wrapping material dispenser.

12. The apparatus of claim 7, wherein the dispenser frame comprises a first rotating arm supporting the first wrapping material dispenser and a second rotating arm supporting the second wrapping material dispenser, the first and the second rotating arms being engageable in rotation about the load during the wrapping cycle.

13. An apparatus for wrapping a load with a first web material and a second web material, the load comprising an upper portion having an upper surface and defining an upper peripheral surface and a lower portion having a lower surface and defining a lower peripheral surface, the apparatus comprising:

a dispenser frame having a first starting position, a first end position, a second starting position, and a second end position, wherein the first starting position is an uppermost position, the first end position is a lowermost position, the second starting position is a second lowermost position, and the second end position is a second uppermost position;

a first wrapping material dispenser mounted to the dispenser frame and being vertically translatable therealong and along a first wrapping path extending between the first starting position and the first end position, the first wrapping material dispenser being configured to at least partially wrap the upper peripheral surface of the load with the first web material upon a relative rotation between the load and the first wrapping material dispenser during a wrapping cycle;

a second wrapping material dispenser mounted to the dispenser frame and being vertically translatable therealong and along a second wrapping path extending between the second starting position and the second end position, the second wrapping material dispenser being configured to at least partially wrap the lower peripheral surface of the load with the second web material upon a relative rotation between the load and the second wrapping material dispenser during the wrapping cycle;

a first web retaining assembly adjacent to the first starting position to hold a tail of the first web material; and a second web retaining assembly adjacent to the second starting position to hold a tail of the second web material.

14. The apparatus of claim 13, wherein the first wrapping path extends in the upper portion of the load and the second wrapping path extends in the lower portion of the load.

15. The apparatus of claim 13, wherein the first wrapping path and the second wrapping path at least partially overlap.

16. The apparatus of claim 13, wherein the dispenser frame comprises a first stationary dispenser support supporting the first wrapping material dispenser and a second stationary dispenser support, spaced-apart from the first dispenser support, and supporting the second wrapping material dispenser.

17. The apparatus of claim 13, wherein the dispenser frame comprises a first rotating arm supporting the first wrapping material dispenser and a second rotating arm supporting the second wrapping material dispenser, the first and the second rotating arms being engageable in rotation about the load during the wrapping cycle.

* * * * *